US005190394A

United States Patent [19]

Mallon et al.

[11] Patent Number: 5,190,394

[45] Date of Patent: Mar. 2, 1993

[54] ADJUSTABLE GLAREFOIL ASSEMBLY

[75] Inventors: Richard D. Mallon; Michael M. Leigh, both of Carson City, Nev.

[73] Assignee: Carsonite International Corp., Carson City, Nev.

[21] Appl. No.: 712,594

[22] Filed: Jun. 10, 1991

[51] Int. Cl.[5] ..... E01F 9/00

[52] U.S. Cl. ..... 404/6; 404/9

[58] Field of Search ..... 404/6–9, 404/15, 16; 256/13.1

[56] References Cited

U.S. PATENT DOCUMENTS

| | | | |
|---|---|---|---|
| 4,338,041 | 7/1982 | Schmanski | 404/9 |
| 4,955,753 | 9/1990 | McKay | 404/6 |
| 5,022,781 | 6/1991 | Smith | 404/6 |

*Primary Examiner*—Thuy M. Bui

*Attorney, Agent, or Firm*—Thorpe, North & Western

[57] ABSTRACT

An adjustable glarefoil assembly is provided for mounting to a median barrier which divides opposing lanes of a highway and operates to reduce the glare of headlights from oncoming vehicles. The glarefoil assembly includes a plurality of glarefoil blades which are adjustably coupled for angular movement with respect to a base runner section in an appropriate light blocking orientation. The base runner section is rigidly mounted to the top of the median barrier at between three and five spaced points, thereby preserving some latitude for vibrational movement within the base runner section. The glarefoil blades are each adjustable about a vertical, longitudinal axis so as to optimally provide sight obstruction for a variety of different road curvatures, as well as maintaining the best possible angle to prevent wind build-up.

10 Claims, 3 Drawing Sheets

ADJUSTABLE GLAREFOIL ASSEMBLY

BACKGROUND

1. FIELD

This invention relates generally to systems for preventing headlight glare from oncoming traffic on a divided highway, and more specifically to a glarefoil assembly in which light obstructing members are adjustable.

2. PRIOR ART

Blinding headlight glare has long been a problem for travellers on divided highways. Responsive to this problem, a number of attempts have been made to reduce the dangers inherent thereto. For example, shrubbery and other plants have been planted on islands or median barriers separating the divided lanes to block out glare from oncoming traffic. This attempt has been largely unsuccessful, however, due to the inordinate amount of time and effort necessarily expended in keeping the plants watered, trimmed and otherwise cared for. Also, a long wait is associated with initially growing the plants to an acceptable level and the crews responsible for the maintenance of the plants are subjected to substantial safety risks when working in the middle of a busy highway or interstate freeway.

Another attempt to reduce the glare associated with two-way traffic is the use of a solid screen made of aluminum or a similar rigid material and mounted to steel posts imbedded in the top of the median barrier. While effective in eliminating headlight glare, maintenance and cost considerations make this alternative undesirable. Screens of this sort often come loose from anchorings and supports as they are buffeted about by winds, many of which may be caused by passing traffic. Also, large aluminum screens which are torn or otherwise damaged, even when only minor damage is sustained, require replacement of the entire screen.

Such screens are further the object of mischief and vandalism in the form of thrown articles such as rocks, bottles and hardened refuse. This, of course, only adds to the problems associated with solid screens already mentioned. Another problem with rigid screens is that they can serve as a solid barrier for police, ambulances and other emergency vehicles. Thus, not only can critical delays be caused by these screens, but they can also become very expensive as they are cut through to allow passage of such vehicles in response to emergency situations.

Responsive to the problems encountered with the use of rigid screens, glarefoils, which are mounted individually on the top of median barriers, were created. These foils extend up to four feet above the median barrier and are constructed of polyethylene or a similar type of thermoplastic material. A great advantage is provided by these glarefoils in that they provide better cross-over access by emergency vehicles and also in that maintenance costs and problems are significantly lessened. Glarefoils are smaller, less costly and can be replaced much easier than the rigid solid screens mentioned above. Also, the flexibility of these glarefoils allows them to yield upon impact with objects such as those already described and then regain their normal shape and position.

Some disadvantages are experienced with glarefoils, however. The typical glarefoil is individually mounted directly to the top of the median barrier by several bolts. Because of this, the installation, removal and replacement of each glarefoil is time consuming and therefore costly. Further, the material of which these foils are constructed becomes brittle over time and thus they become prone to break off when exposed to extreme temperatures, ultraviolet radiation from the sun and constant buffetings by the wind and air currents from passing cars.

An improved glarefoil assembly is disclosed and claimed in applicant's U.S. Pat. No. 4,338,041 issued in 1982. This glarefoil provides improved materials which not only last longer than materials theretofore used, but which also have the capabilities of transmitting vibrational energy, caused by impact with moving objects or wind, from the point of impact on a glarefoil to a base runner. The base runner functions as a mounting plate for the individual glarefoil blades and is thus affixed to the top of the median barrier. Hence, when the glarefoils are buffeted by wind or impacted by an object, the resulting vibrational energy is transferred to the base runner, which, because it is attached to the median barriers at only three to five points, begins to vibrate. Vibrational energy transferred from other glarefoil blades counteract and dampen the vibration in the base runner, as do the fixed points of the base runner, with a net result of cancellation of much of the vibrational energy.

While the '041 patent has substantially furthered the art of glarefoils, a distinct limitation remains. Specifically, the '041 patent teaches a glarefoil member which is rigidly connected to the base runner in fixed angular orientation. Because the blades are spaced at fixed distances and angles, they are not adaptable for use with more than one road curvature. For example, if a set of glarefoil blades are oriented so as to prevent sight access on a straight road in optimum fashion, those same blades cannot be used to prevent sight access on a curved road because approaching cars in one of the lanes are allowed to see through the blades, thus defeating the purpose.

Such a limitation mandates that either the assembly only be used on one specific curvature of road or else that the glarefoil blades overlap each other in order to allow for placement on a variety of road curvatures. Overlap constitutes a significant waste of materials and manufacturing cost.

Furthermore, when the orientation of the glarefoil bladder is preset and nonadjustable, a given set of glarefoil blades can be used only on either the median strip between opposing lanes of traffic or on the exterior edge of a lane of traffic, but not on both, since the correct sight inhibiting orientation for the median strip is opposite that for the exterior edge.

Therefore, a legitimate need exists for a glarefoil assembly having the characteristics described in the 041 patent having the further feature of angularly adjustable glarefoil blades to allow for adaptability to a variety of road curvatures.

A more detailed description of the prior art has been catalogued and summarized in a publication of the Transportation Research Board of the National Research Counsel in cooperation with the Federal Highway Administration, entitled "Glare Screen Guidelines." This report is dated December 1979 and is available from the Transportation Research Board of the National Academy of Sciences, Washington, D.C.

BRIEF SUMMARY AND OBJECTS OF THE INVENTION

Accordingly, a principal object of the present invention is the provision of an improved glarefoil assembly for mounting on top of a median barrier wherein upright glarefoil blades are angularly adjustable about a longitudinal axis.

Another principal object of this invention is to provide a glarefoil assembly which is adjustable so as to have use in a variety of different curvatures of a variety of different streets or roads.

Still another principal object is the provision of a glarefoil assembly for use both in the median strip of a highway as well as on the exterior edge thereof.

A further significant object of the invention is to provide a glarefoil assembly which is able to bear stress and strain placed on the glarefoil blades by the impact of objects and the rush of air currents, and translate such stress and strain into wave actions which are dampened by the glarefoil assembly as a whole.

Another important object is the provision of a glarefoil assembly that is easy and inexpensive to install and remove, and which requires little maintenance, thus greatly reducing labor time and cost.

It is still another object of the present invention to provide a glarefoil assembly which is easy and inexpensive to manufacture and assemble.

These and other objects of the present invention are manifested in an adjustable glarefoil assembly comprising a plurality of light obstructing members which are adjustably mounted to the top face of a base runner section to form an integral, modular structure. The bottom face of the base runner section is attached to the top of a standard median barrier, but only at three to five points. The base runner provides not only a modular structure which is more easily mounted to the median barrier than individual glarefoils, but the base runner also functions to receive vibrational energy absorbed by the light obstructing members.

The base runner and light obstructing members are constructed of flexible materials having mutually compatible elastic moduli and thus, when the light obstructing members are subjected to buffeting from the wind or impacted by an object such as a thrown rock or bottle, some of the resultant vibrational energy is transferred to the base runner which then also vibrates because it is attached to the median barrier only at three to five points. This vibrational energy is transferred into the base runner in the form of wave motions which are superimposed on other wave motions within the base runner emanating from other light obstructing members. Because of this, as well as rebound energy from the fixed points of the base runner, the wave actions are self dampening within the base runner.

In other words, the effect of superimposition of nonharmonic vibrations within the base runner results in a cancellation of part or all of the vibrational energy as opposing waves traverse simultaneously in the base runner section. Such a dissipation of vibrational energy relieves the glarefoil assembly of a portion of the vibrations within the glarefoil blades which would otherwise tend to concentrate at localized points of stress, thus greatly reducing the risk of failure.

Each glarefoil blade is attached to the base runner section in an adjustable fashion such that each blade can be rotated selectively about vertical longitudinal axis without removal of the blade from the base runner section. This feature allows selection of positions at which sight through the glarefoil assembly is blocked to be varied according to the layout of the road, the position on the road at which the assembly is used, and how much sight is to be blocked.

For example, when the road upon which the median barrier is placed is straight, the angle that each individual glarefoil blade makes with the base runner portion is necessarily greater than when the road is curved. Optimization of the glarefoil assembly requires not only that the sight capability through the glarefoil assembly is negated, but also that the angle made by the glarefoil blades with the base runner assembly be as close to a right angle as possible to assure less wind resistance, and therefore wear and tear on the glarefoil blades.

BRIEF DESCRIPTION OF THE DRAWINGS

The above and other objects, features and advantages of the invention will become apparent from a consideration of the following detailed description presented in connection with the accompanied drawings in which.

DETAILED DESCRIPTION OF THE PREFERRED EMBODIMENT

Figure 1:
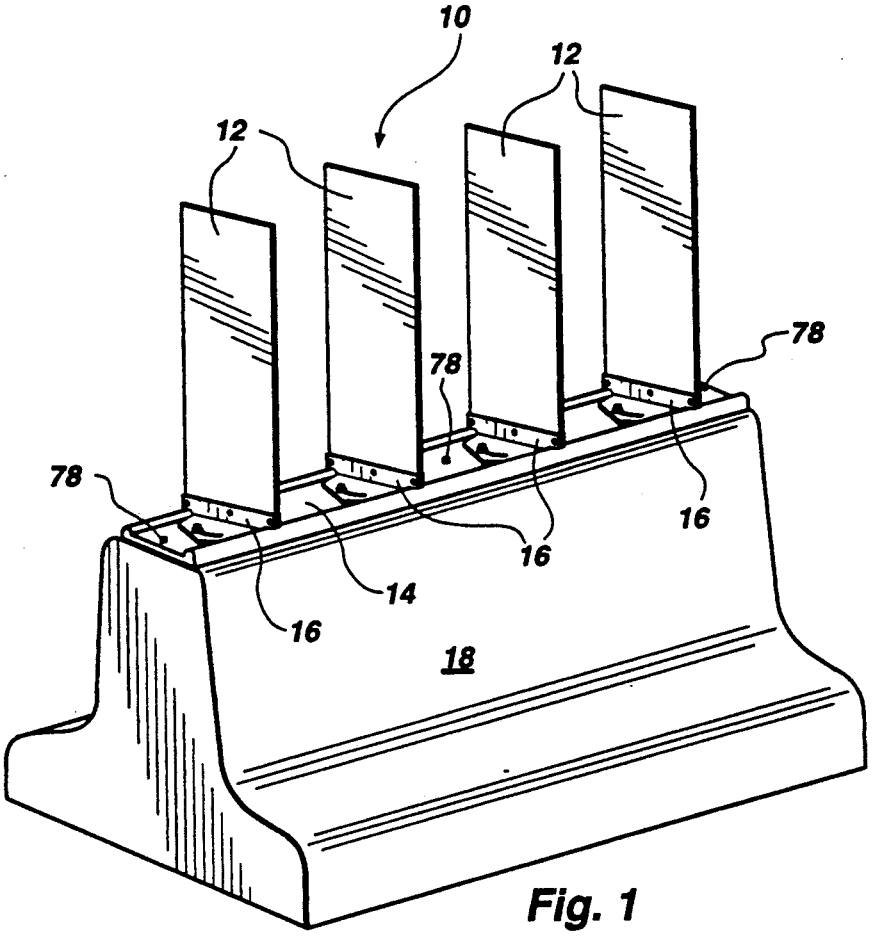
FIG. 1 is a perspective view of the adjustable glarefoil assembly of the present invention, shown mounted to a median barrier.
Figure 2:
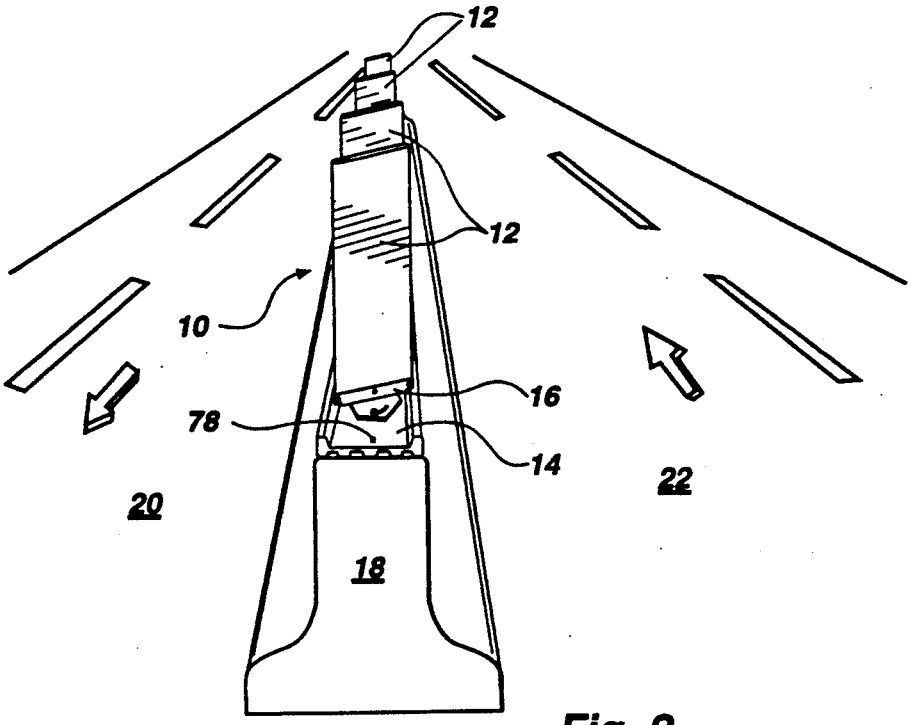
FIG. 2 is an end perspective view of the adjustable glarefoil assembly of FIG. 1 shown in position in the median strip along a divided highway.

Reference is now made to the drawings wherein like numerals are used to denote like components throughout. The adjustable glarefoil assembly of the present invention, generally designated 10, comprises a plurality of elongate opaque glarefoil blades 12, each; having opposing faces are coupled to an elongate base runner section 14 by apposing adjustable angular attachment plates 16, the base runner section 14 being coupled to the top of a standard median barrier 18. Each of these components will be described in greater detail hereinafter.

Each elongate opaque glarefoil blade 12, of which there are preferably at least four per base runner section 14, and its corresponding adjustable attachment plate 16 are identical in function and construction and thus will only be described once herein. The blades 12 are adjustably adapted to reduce or eliminate headlight glare from on-coming traffic along a divided highway.

In the preferred embodiment, each blade 12 is constructed of fiberglass or fiber reinforced plastic, however, other materials may be used. The elastic modulus of fiberglass composite (approximately 1–6 million) is well adapted for such a glarefoil blade because it has inherent rigidity and weatherability to remain functional, yet can be structured to withstand random impacts of objects such as thrown rocks or bottles without incurring the immediate need for maintenance. Also, such fiberglass composite materials can be readily formed into various geometric cross-sections to maximize opposing characteristics of flexibility and rigidity at minimal cost.

The preferred cross-sectional shape of each glarefoil blade 12 is that of a thin extended Ibeam, although it is within the purview of this invention that rectangles, ovals, diamonds, and other shapes of cross-sections be used. See FIGS. 3 and 6–8. As shown in FIGS. 1 through 4, each glarefoil blade 12 is adjustably attached at one elongate end thereof to a base runner 14, as hereinafter described in greater detail. The opposing end of each blade 12 extends upwardly and is unattached. FIGS. through 4 further illustrate that each blade 12 stands substantially vertical in relation to the horizontally positioned base runner 14 which is mounted atop a standard median barrier 18. Also, the blades 12 are preferably parallel in relation to each other so as to act in concert to preclude the desired amount of sight access from one side of the highway 20 to the other 22, and vice versa, or alternatively to preclude sight access from the highway to a work site adjacent thereto.

Figure 3:
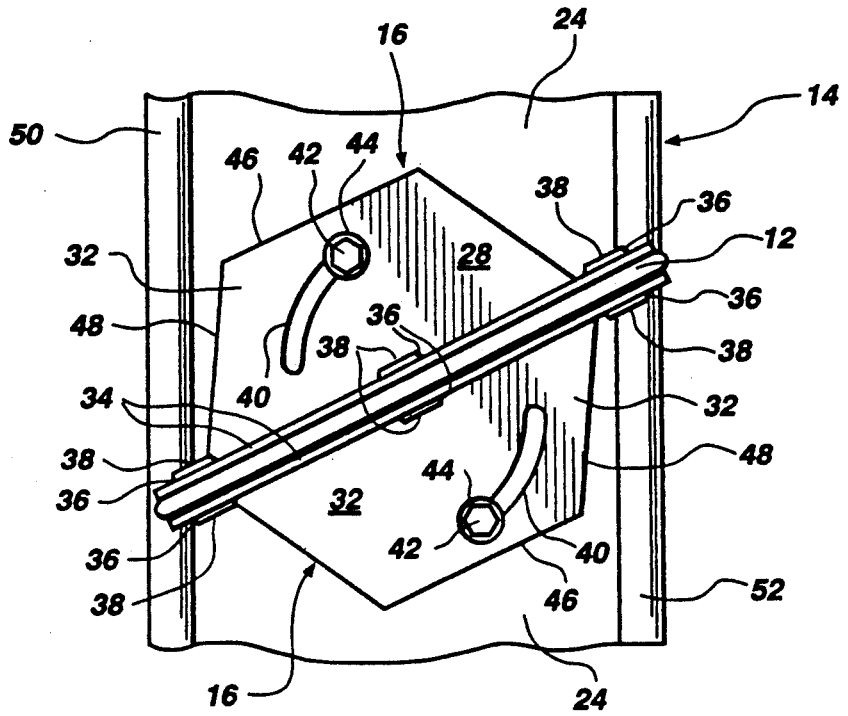
FIG. 3 is a top plan view of the adjustable glarefoil assembly of FIG. 1 illustrating how each glarefoil blade is adjustably mounted to the base runner portion.
Figure 4:
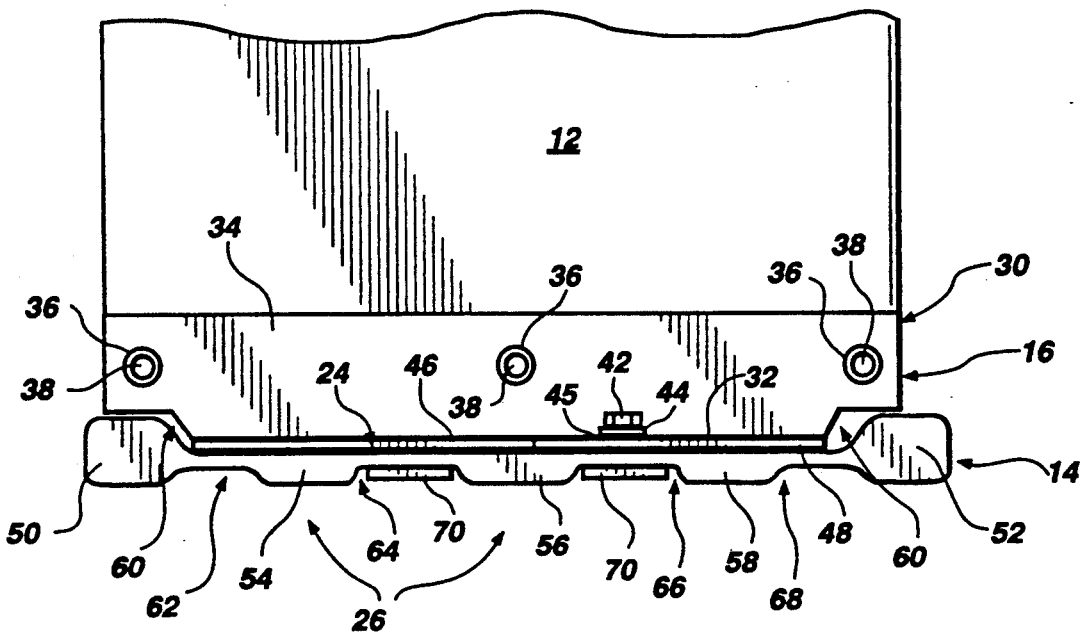
FIG. 4 is an end elevational view of the adjustable glarefoil assembly of FIG. 1.

The elongate base runner section 14, to which the glarefoil blades 12 are attached, has both a bottom face 26 for attachment to the median barrier 18, and a top face 24 opposing the bottom face 26. As shown in FIGS. 1 through 4, an adjustable attachment plate 16 attaches one end of each of the glarefoil blades 12 to the top face 24 of the base runner section 14 such that each blade 12 can be angularly adjusted into an upright light blocking orientation with respect to a variety of different projected median barrier locations. As best seen in FIGS. 3 and 4, the attachment plate 16 comprises in actuality two separate plates designated 28 and 30. Plates 28 and 30 are identical in virtually every aspect.

Each plate 28 and 30 has a horizontal portion 32 for attachment to the base runner 14 and a vertical portion 34 for attachment to a blade 12. Vertical portion 34 of each plate 28 and 30 includes a number of preset apertures 36 at spaced intervals, the apertures 36 in plates 28 and 30 being matched such that pop-rivets 38 are fitted through the apertures 36 to connect plates 28 and 30, as well as a blade 12, together. It should be readily recognized that other appropriate attachment means, such as nuts and bolts, may be used in the place of pop-rivets.

The horizontal portion 32 of each plate 28 and 30 includes a curved slot 40 through which an appropriately sized bolt 42 and corresponding washer 44 pass. An appropriately sized aperture, not shown, is drilled or otherwise formed through base runner 14 to receive each bolt 42. Also, a corresponding aperture 45, transverse to each bolt 42, is formed through base runner 14 in the event that a different vertical alignment of glarefoil blades 12 is desired, as described in greater detail hereafter. (See FIG. 5).

As best shown in FIG. 3, curved slot 40 in plates 28 and 30 has one end located near the center of the exterior edge 46 of horizontal portion 32, and extends towards one of the lateral edges 48 of horizontal portion 32, where the second end is located. FIG. 3 shows the horizontal portion 32 of plates 28 and 30 to be in the shape of a trapezoid, although other shapes are contemplated and fall within the scope of this invention. The plates 28 and 30 are constructed of a structural material, preferably aluminum, which adds strength to the assembly as well as facilitates the transfer of vibrational energy from the blades 12 to the base runner 14. Other rigid metals or plastics could be used, provided the meet the requirement for strength and facilitate the referenced energy transfer to the base runner section 14.

It will be recognized that curved slots 40 in the horizontal portion 32 of plates 28 and 30 have a concave configuration with respect to attached blades and work together to facilitate selective varying of the angle which each blade 12 makes with the horizontal base runner 14. This allows the construction or maintenance worker to vary the amount of sight access between one lane 20 of a highway and the opposing lane 22. Also, this capability allows this glarefoil assembly 10 to be used on straight sections of roadway as well as varying degrees of curved roadways. Varying the angle which each blade 12 makes with the base runner 14 is easily accomplished by loosening bolts 42 and manually rotating each blade 12 to the desired angle and then retightening the bolts 42. As is readily apparent, each glarefoil blade 12 is secured by two bolts 42, each of which must be loosened and retightened when adjusting each blade 12.

Figure 5:
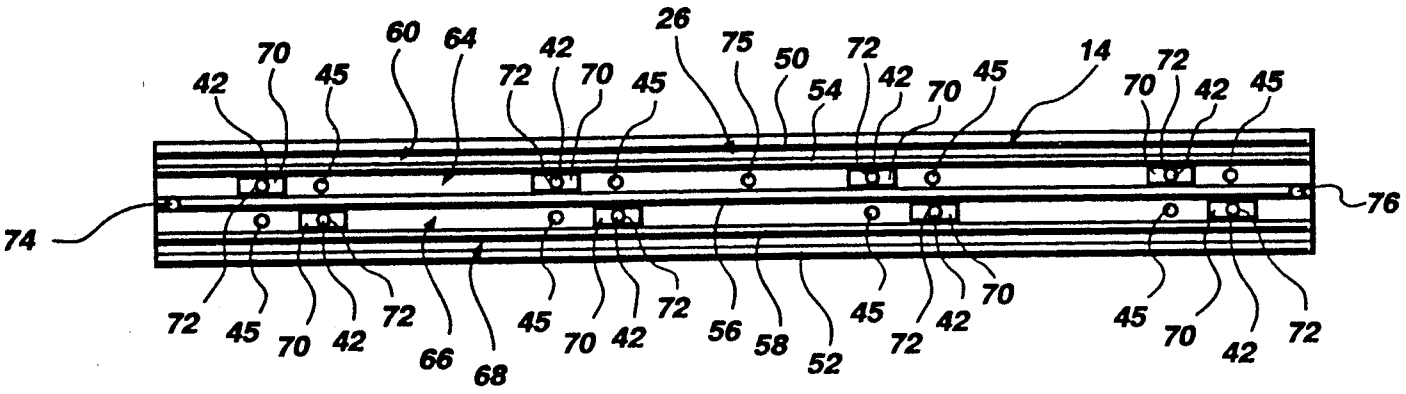
FIG. 5 is a bottom plan view of the base runner section of the adjustable glarefoil assembly of FIG. 1.
Figure 7:
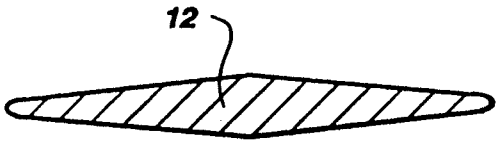
FIG. 7 is an isolated cross-section of another preferred glarefoil blade.
Figure 6:
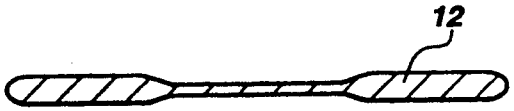
FIG. 6 is an isolated cross-section of a preferred glarefoil blade.
Figure 8:
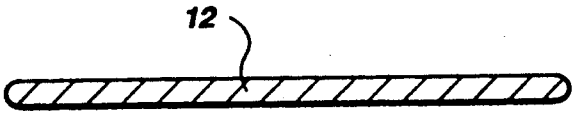
FIG. 8 is an isolated cross-section of still another preferred glarefoil blade.

Reference is now made to FIGS. 4 and 5, which illustrate the preferred base runner section 14. Elongate base runner section 14 has sufficient length to accept a significant transfer of vibrational energy from an attached outer source such as glarefoil blades 12. FIG. 4 illustrates the preferred cross-section of base runner 14 and clearly shows a plurality of reinforcing ribs: exterior reinforcing ribs 50 and 52, as well as interior reinforcing ribs 54, 56, and 58. Exterior reinforcing ribs 50 and 52 provide greater structural integrity for base runner 14 at the exterior edges thereof and give base runner 14 an overall I-beam configuration. FIG. 4 also shows that notches 60 in vertical portion 34 of each plate 28 and 30 prevent plates 28 and 30 from contacting exterior reinforcing ribs 50 and 52.

Interior reinforcing ribs 54, 56 and 58 extend downwardly only from the bottom face 26 of base runner 14. This is in contrast to exterior reinforcing ribs 50 and 52 which extend both upwardly and downwardly. The apertures through which bolts 42 extend, as well as apertures 45, are disposed in the interior two channels 64 and 66 of the four channels 62, 64, 66 and 68 formed by the combined configuration of the reinforcing ribs 50, 52, 54, 56 and 58. (See FIGS. 4 and 5)

FIG. 3 and FIG. 5 clearly show that the two bolts 42 which secure any one glarefoil plate 12 to base runner 14 are not disposed in the same channel, but rather are disposed alternately in channels 64 and 66. It will also be recognized that a full range of rotation is not provided by the present configuration of curved slots 40. A broader range of rotation is achievable by switching each bolt 42 from the aperture through which it presently passes to the aperture 45 directly transverse thereto.

FIG. 5 illustrates rectangular nuts 70 which have threaded apertures 72 for receiving bolts 42 to secure plates 28 and 30 to base runner 14. Nuts 70 are preferably rectangular so as to remain securely entrenched in channel 64 or channel 66 without rotating when bolts 42 are loosened or tightened. Since base runner 14 is attached to the top of the median barrier 18, as shown in FIGS. and 2, it is advantageous to use a non-rotating nut 20 so that tightening and loosening of corresponding bolts 42 may be accomplished without detaching base runner 14 from the top of median barrier 18.

Base runner section 14 further comprises apertures 74, 75 and 76 located at spaced intervals along base runner 14. Apertures 74, 75 and 76 receive bolts or screws 78, which securely attach base runner 14 to the top surface of the median barrier 18. At present preference, no less than three and no more than five bolts are used to secure base runner 14. Being attached to the median barrier 18 at spaced attachment locations allows vertical movement of the base runner 14 in response to vibrational energy in the form of waves transmitted from the glarefoil blades 12 to the base runner section 14, where the vibrational energy dissipates.

Base runner section 14 is of sufficient length to permit a substantial receipt of vibrational energy from attached glare blades 12. As the wind and air currents from passing automobiles cause the glare blades 12 to vibrate, part of the vibrational energy is transferred to the rigid attachment plate 16 and then into the base runner 14, where it is dissipated by nonharmonic vibrations emanating from other glare blades 12. This principle is fully described in applicant's U.S. Pat. No. 4,338,041 issued in 1982, the entirety of which is hereby incorporated by reference as an integral part of this application for patent.

The transfer of vibrational energy from glarefoil blades 12 through attachment plate 16 and into the base runner section 14 to assist in dissipation of the vibrational energy is facilitated by constructing these components of composition with physical characteristics and configurations which enhance their capability to transfer vibrational energy. Elastic modulus and moment of inertia are two such physical characteristics which can be exploited to more easily effect such a transfer. By matching the elastic modulus of each glarefoil blade 12 to that of the base runner 14, reflection of vibrational energy back into the glare blade 12 is reduced. Instead, the vibrational energy is carried directly into the base runner 14 in accordance with well-known wave propagation theory.

With respect to the second element, moment of inertia, its use in the present structure is primarily for the purpose of developing rigidity to improve the support and resilience of each glare blade 12 and base member portion 14 of the glarefoil assembly 10. This more rigid structure tends to enhance the propagation of vibrational waves in the same manner that a taut string or rubber band has better wave transmittal characteristics than a loose string. Just as the taut string has resilience to maintain propagation of the wave, the use of ribs and other reinforcing structure which increase moment of inertia operate to improve resilience and transmittance of vibrational energy.

It will be apparent that the structure disclosed by the preferred embodiment herein is only illustrative and should not be considered as the only structure suitable for carrying out the subject invention. It should therefore be understood that the present disclosure is by way of example only and that variations are possible without departing from the scope and spirit of the hereinafter claimed subject matter, which subject matter is to be regarded as the invention.

We claim:

1. An adjustable glarefoil assembly for mounting to a median barrier along a divided highway comprising:

an elongate base runner section having a bottom face for attachment to the median barrier and a top face opposing the bottom face, a plurality of elongate glarefoil blades having two opposing faces and being adapted to reduce headlight glare from oncoming traffic along the divided highway, and adjustable coupling means attached at both of the opposing faces and at one end of each of the glarefoil blades and to the top face of the base runner section at forward and rearward positions with respect to the glarefoil blades such that each glarefoil blade can be angularly adjusted selectively into a plurality of upright, light blocking orientations with respect to a variety of different projected median barrier locations without removal of the blade from the base runner section or removal of the base runner section from the median barrier.

2. A glarefoil assembly as defined in claim 1, wherein at least four glarefoil blades are provided for each base runner section.

3. A glarefoil assembly as defined in claim 1, wherein the adjustable coupling means comprises a pair of angularly adjustable angular attachment plates attached at opposing faces of the blades.

4. A glarefoil assembly as defined in claim 3, wherein each separate plate has a horizontal portion for attachment to the base runner section and a vertical portion for attachment to one of the opposing faces of the glarefoil blade.

5. A glarefoil assembly as defined in claim 4, wherein the horizontal portion of each separate plate includes a curved slot through which a bolt passes, said slot having concave configuration with respect to the attached blade.

6. A glarefoil assembly as defined in claim 1, wherein each glarefoil blade has the cross-sectional shape of a thin extended I-beam.

7. A glarefoil assembly as defined in claim 1, wherein each glarefoil blade has the cross-sectional shape of a rectangle.

8. A glarefoil assembly as defined in claim 1, wherein each glarefoil blade has the cross-sectional shape of a diamond.

9. A glarefoil assembly as defined in claim 1, wherein each glarefoil blade has the cross-sectional shape of an oval.

10. A glarefoil assembly as defined in claim 1, wherein the base runner section is attached to the median barrier at separated attachment locations to allow vertical movement of the base runner in response to vibrational energy transmitted from the glarefoil blades to the base runner section, where the vibrational energy is dissipated.

* * * * *